US006112429A

United States Patent [19]

Mitchell et al.

[11] Patent Number: 6,112,429

[45] Date of Patent: Sep. 5, 2000

[54] METHOD AND APPARATUS FOR WASHING AND DRYING HARVESTED VEGETABLES

[75] Inventors: Josh Mitchell; Stephen F. Griffin, both of Monterey, Calif.

[73] Assignee: Griffin Produce, Inc., Salinas, Calif.

[21] Appl. No.: 09/251,589

[22] Filed: Feb. 17, 1999

Related U.S. Application Data

[63] Continuation-in-part of application No. 09/197,342, Nov. 20, 1998, Pat. No. 5,992,042.

[51] Int. Cl.[7] ..... F26B 5/08

[52] U.S. Cl. ..... 34/312; 34/322; 34/58; 34/60; 34/209; 34/236

[58] Field of Search ..... 34/58, 60, 62, 34/63, 202, 209, 236, 312, 318, 322, 328; 15/3.11, 3.12; 134/25.3, 72, 73, 74, 104.4; 426/302, 489, 506, 532; 99/489, 536, 623

[56] References Cited

U.S. PATENT DOCUMENTS 5,413,131 5/1995 Medlock ..... 134/104.4
5,675,905 10/1997 Hougham ..... 34/58

*Primary Examiner*—Pamela A. Wilson
*Attorney, Agent, or Firm*—J. William Wigert, Jr.; Crosby Heafey Roach & May

[57] ABSTRACT

A method and apparatus for processing whole head vegetables, characterized by a core end, and an open leafy end, is disclosed. Whole head vegetables pass through a washer which has a bottom belt which runs through the length of the washing line and passes through a first and a second tank (or more tanks) of cleaning water. Between the first and second cleaning tanks, a plurality of spray bars further clean the whole head vegetables. Top belts at each of the cleaning tanks above the bottom belt to secure the produce as it passes through the first cleaning tank and through the second cleaning tank. The lower belt, and the upper belts are controlled by a single speed control system resulting in less damage to the produce. Additionally, the angle of the belts conveying the produce through the two cleaning tanks is chosen for optimum performance. After the produce is washed, baskets, or totes, filled with the wet produce to be dried, are stacked vertically on a rotatable turntable assembly within an inner support frame. The totes are arranged with the open tops facing upwardly. A worker, to load the totes in the dryer, slides each tote within the inner frame with one on top of the other. The inner support frame has a top and bottom spindles or shafts which are rotationally supported by bearing structures at the top and bottom of the dryer. Moisture is driven out by centrifugal force when the inner support frame/totes are rotated.

17 Claims, 10 Drawing Sheets

METHOD AND APPARATUS FOR WASHING AND DRYING HARVESTED VEGETABLES

RELATED APPLICATIONS

This is a continuation-in-part application of co-pending patent application Ser. No. 09/197,342 entitled Improved Dryer For Drying Harvested Vegetables, filed Nov. 20, 1998, now U.S. Pat. No. 5,992,042 assigned to the same assignee as the present application.

FIELD OF THE INVENTION

The present invention relates to washing and processing produce such as lettuce, leafy vegetables and the like, and in particular to whole head vegetables.

RELATED ART

In the field produce such as lettuce, leafy and other vegetables, are harvested both by hand and by mechanized equipment. Produce cut in the field is often put into, transported, and stored in containers or baskets, often referred to as "totes". Typically, theses totes are made of plastic, are constructed to have multiple openings in the sides and bottom, and are open at the top where the produce is put into the tote.

The harvested produce is transported to a production facility where, among other things, the produce is washed, dried, weighed, trimmed, packaged and shipped. During the washing phase produce is typically emptied from the individual totes and washed in bulk. Afterwards, the produce must be dried before the remaining steps. In some drying operations, the produce is dried in bulk. But it is convenient if the produce can be re-introduced into standard totes for drying and subsequent processing.

SUMMARY OF THE INVENTION

In accordance with the present invention, a method and apparatus for processing whole head vegetables, characterized by a core end, and an open leafy end, is set forth. In particular, whole head vegetables pass through a washer which has a bottom belt which runs through the length of the washing line and passes through a first and a second tank of cleaning water. Between the first and second cleaning tanks, a plurality of spray bars further clean the whole head vegetables. Top belts are also provided above the bottom belt to secure the produce as it passes through the first cleaning tank and through the second cleaning tank.

In accordance with another aspect of the invention, the lower belt, and the upper belts are controlled by a single speed control system. Since the belts are thus not individually controlled there is no possibility that there the belts can run at different speeds, which can result in damage to the produce. Additionally, the angle of the belts conveying the produce through the two cleaning tanks is chosen for optimum performance.

The totes are arranged with the open tops facing upwardly. A worker, to load the totes in the dryer, simply slides each tote within the inner frame with one on top of the other. The inner support frame has a top and bottom spindles or shafts which are rotationally supported by bearing structures at the top and bottom of the dryer. Moisture is driven out by centrifugal force when the inner support frame/totes are rotated.

In accordance with another aspect of the invention, a method and apparatus for washing and then drying produce, such as whole head lettuce characterized by having a core or cut end, and an open leafy end, is provided. Such produce is sometimes referred to as whole head lettuce or whole head vegetables. Such produce is normally washed and dried manually rather than mechanically. In accordance with this aspect of the invention, such types of harvested whole head vegetable produce, after being washed, is loaded into one or more individual baskets or totes.

In the preferred embodiment of the invention, one or more totes are filled with produce having a cut end and an open, leafy end after washing. Preferably a plurality of totes are stacked and secured in a rotatable manner within a mechanical dryer. The stack of totes, which are rectangular in shape, are centered on or near the rotational axis within an inner frame or framework. The frame is provided with top and bottom spindle shafts which are supported in bearing supports. The inner frame is rotated so that moisture in the produce is centrifugally forced out of the produce.

In the preferred embodiment, produce such as whole head vegetables are arranged in a preferred manner in the totes for the drying operation. Specifically, rows of produce are arranged in the totes with the cores or cut ends of a row of produce juxta positioned with, or "butted" against, the cut ends of another row, with the leafy ends generally pointing away from the axis of rotation. In this position, water or moisture tends to flow outwardly from the leafy open ends when the inner frame is rotated.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
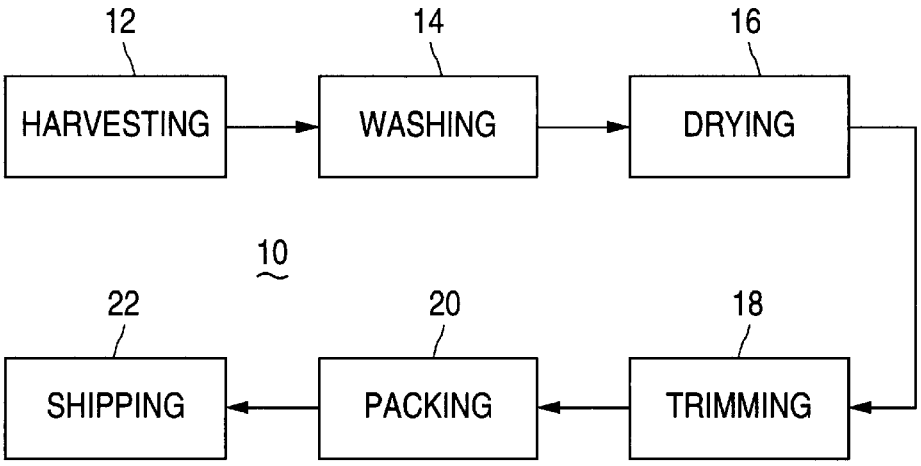
FIG. 1 is a flow chart for processing harvested produce such as lettuce and other leafy vegetables.

FIG. 1 is a flow diagram 10 for processing harvested produce such as lettuces, leafy vegetables, whole head and other vegetables, which will sometimes, collectively be referred to as "produce". By "leafy vegetables" it is meant that family of specialty lettuces and other leafy greens which, when mixed together for sale and consumption are sometimes referred to as "spring mix," "mixed greens," or "baby greens." For example, this includes lettuces, such as green romaine, red romaine, sierra, lola rosa, tango, green leaf, red leaf, little gem, red butter, read oak, red perella and green perella. It also includes greens such as arugula, mizuna, red mustard, green mustard, spinach, tatsoi, red chard and red russian kale.

Figure 2A:
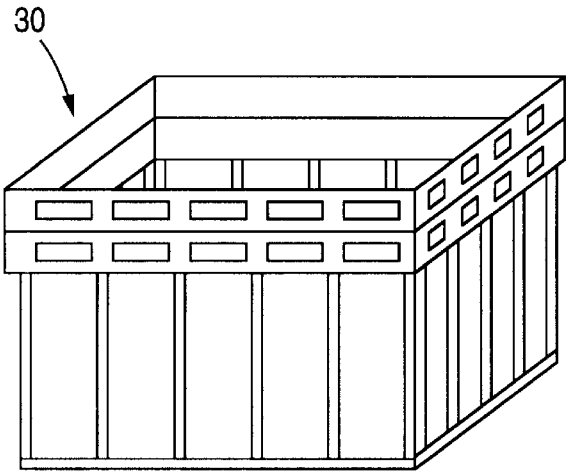
FIG. 2A is a perspective view of a standard basket or tote used to transfer harvested vegetables and FIG. 2B is a top view of a tote loaded with a vegetable such as whole head vegetables.
Figure 2B:
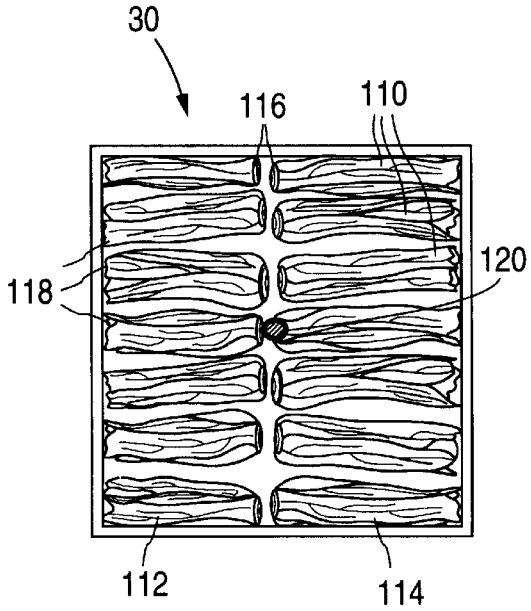

After the produce is harvested, as indicated at 12, the produce is sent to a plant for processing. This is typically accomplished by transporting the produce in standard baskets frequently referred to as "totes". FIG. 2A is a perspective view of a standard basket or tote 30 used to transfer harvested vegetables and FIG. 2B is a top view of a tote loaded with vegetables, such as whole head vegetables, as an example. In the plant the produce is either processed or cooled in a vacuum tunnel and then stored for a short period of time, up to two days.

The produce is then unpacked from the totes and washed in a produce washing machine. The next step 16 is to dry the moist produce. As explained above, some drying machines dry the produce in bulk, while others, such as that shown in U.S. Pat. No. 5,675,905, dry the produce while the produce is stored in totes. Mechanically washing some kinds of vegetables, such as whole head lettuce and other vegetables is difficult to dry mechanically. After drying, the totes are delivered to stations for trimming, if necessary, as indicated at 18. Any damaged or broken leaves are also removed. For whole head products the core is removed or trimmed. After weighing, the trimmed produce is then packed as indicated at 20. Produce is frequently packed in plastic bags or in cardboard boxes. At this point the produce is ready for shipment, as indicated at 22.

Figure 4:
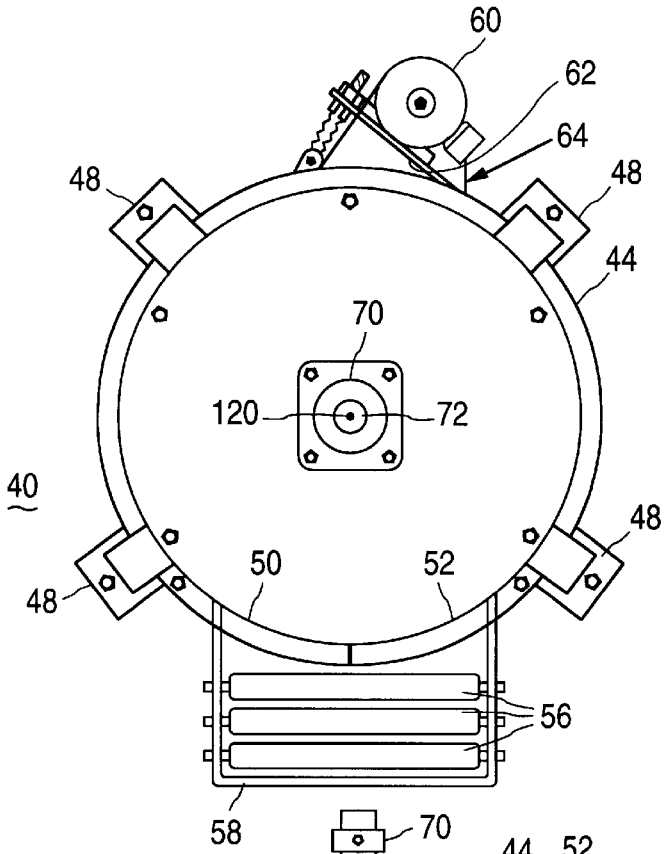
FIG. 4 is a top view of the dryer of FIG. 3.
Figure 3:
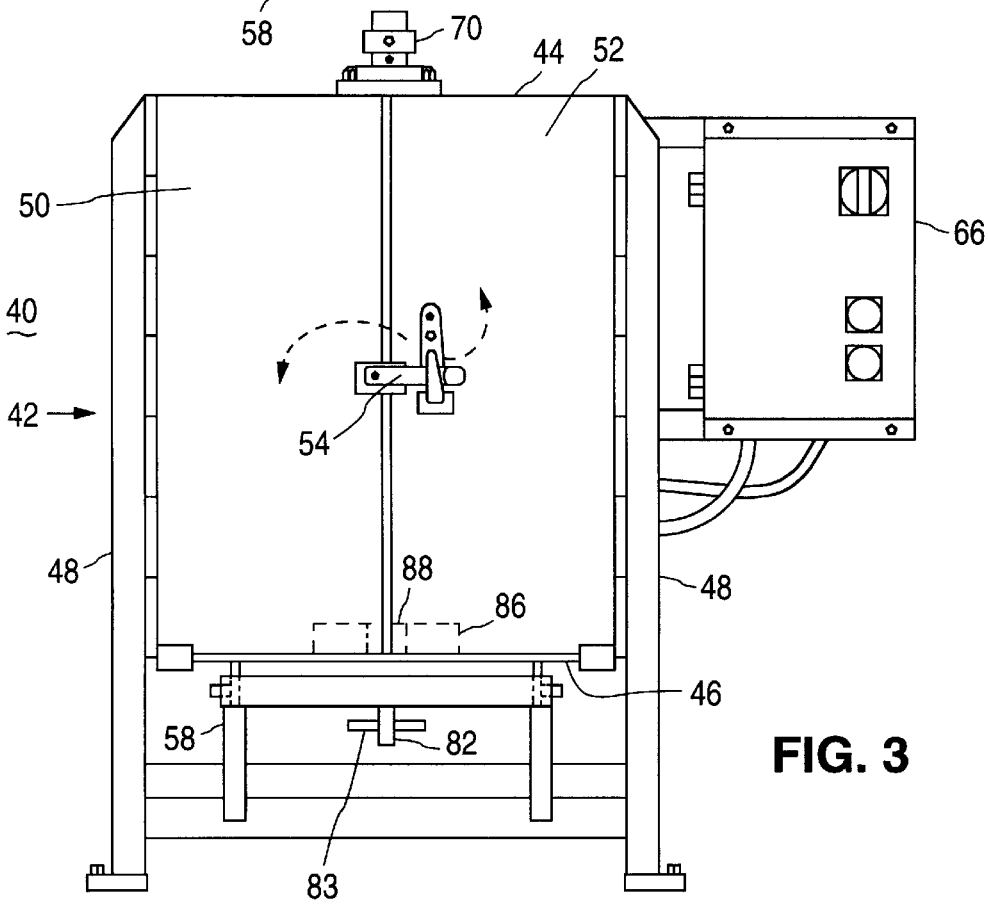
FIG. 3 is a front elevation view of a dryer in accordance with the present invention.

FIG. 3 is a front elevation view, and FIG. 4 is a top view, of a dryer 40 in accordance with the present invention. The dryer 40 has an outer body 42 having a top 44 and a bottom 46. Body 42 is supported by legs 48. A pair of doors 50 and 52 close an opening in the front of outer body 42. The doors are provided with a suitable latching mechanism 54. The doors are open when the dryer is being loaded and closed during a drying operation. A plurality of first rollers 56 are mounted by a bracket 58 to the dryer 40. Rollers 56 facilitate the loading of dryer 40 with a stack of totes 30.

Rotation of the produce-carrying totes 30 is accomplished by the use of a motor 60 attached by a support structure 62 to dryer 40. The motor is provided with a coupling device, such as a V-belt, or preferably, a cleated belt 64. The motor drives rotates the inner body 80 (FIGS. 5 and 6) and the enclosed totes 30. This is accomplished by coupling the cleated belt 64 to a pulley 83 attached to the lower spindle shaft 82 (FIGS. 5 and 6).

A control panel 66 is provided for controlling the operation of dryer 40. A conventional inverter and timer are provided within the control panel 66 to control the duration and revolutions per minute. It is important that the dryer dry the produce thoroughly by turning at an adequate speed, for an adequate period of time, while preventing excess mechanical damage from drying the produce too vigorously. The duration, and speeds of rotation must be empirically determined for each type of produce being dried.

A spindle shaft support 70 is provided at the top of outer body 42. A bearing 72 is provided as a part of support 70. As will be explained below, support 70 anchors and permits rotation of the inner frame containing the totes.

Figure 5:
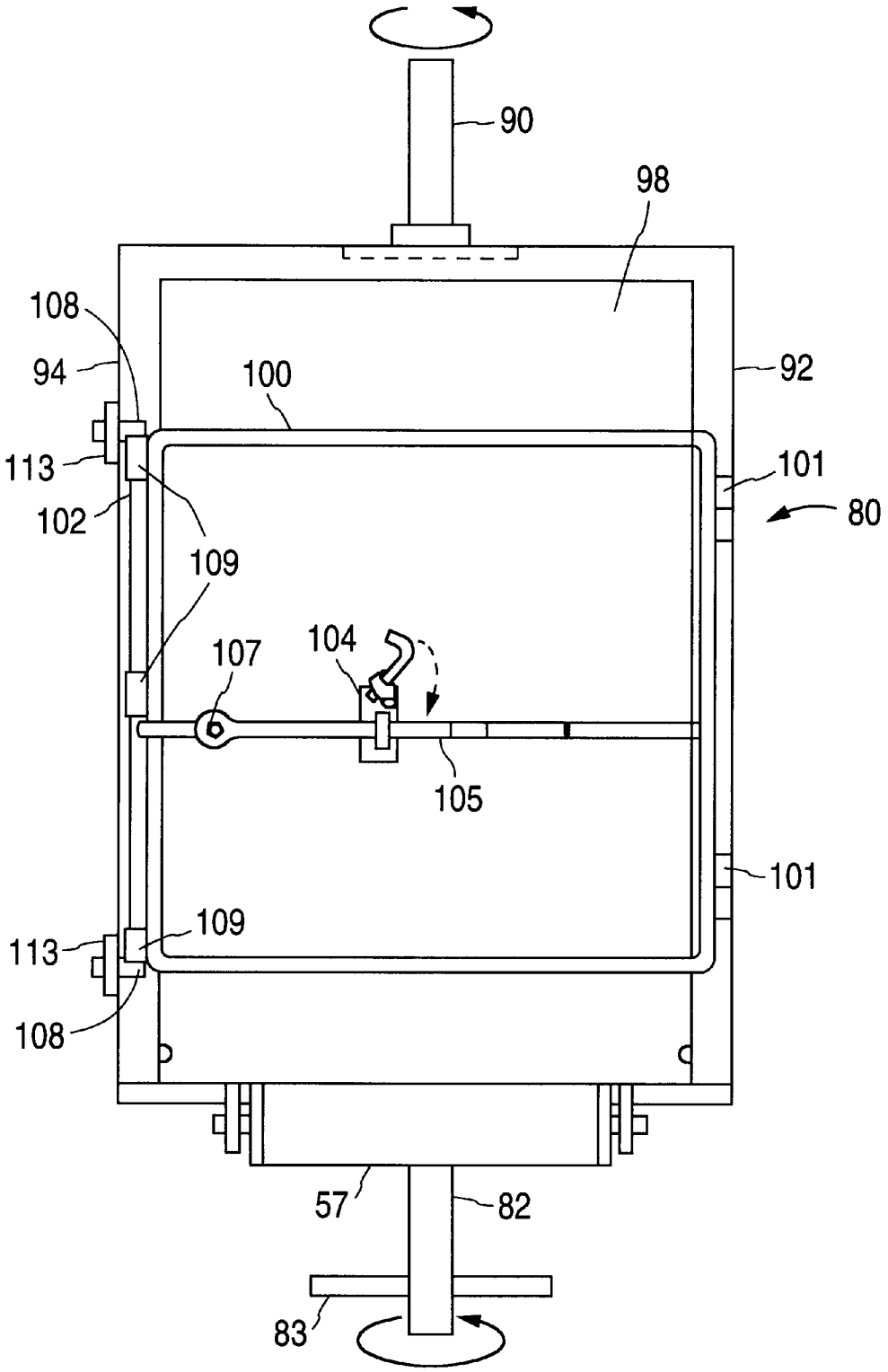
FIG. 5 is a front elevation view of the inner frame of the dryer of FIG. 3.
Figure 6:
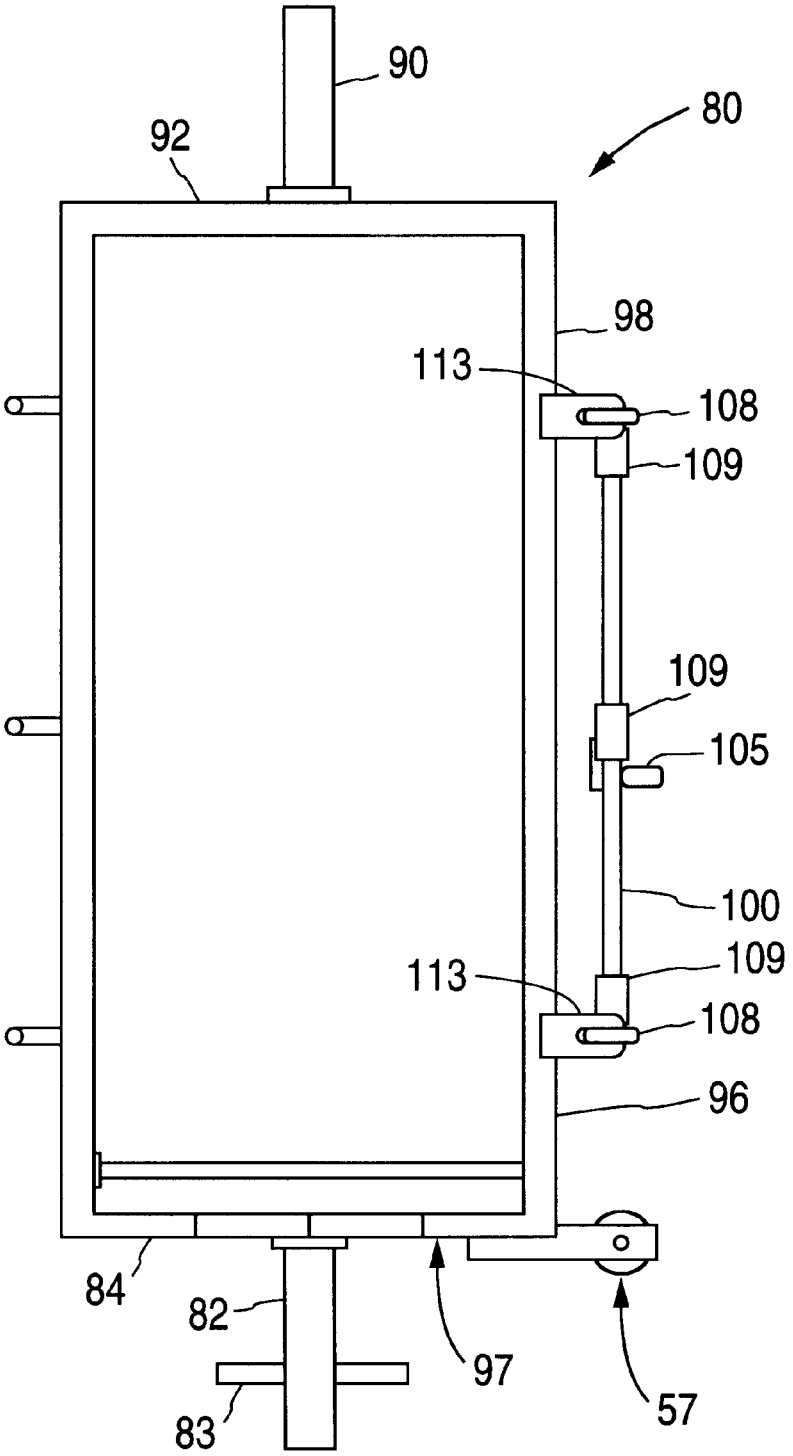
FIG. 6 is a side view of the inner frame of FIG. 5.

FIG. 5 is a front elevation, and FIG. 6 is a side view of the inner frame 80 of the dryer of FIG. 3. Inner frame 80 both supports and secures a stack of totes filled with produce during the drying operation. A lower spindle shaft 82 is connected to the bottom 84 of the inner frame. Spindle shaft 82 is supported by spindle support structure 86 having a central bearing 88 (FIG. 3). An upper spindle shaft 90 is attached to the top 92 of inner frame 80. The shaft 90 is rotationally supported by spindle shaft support 70 and bearing 72 (FIGS. 3 and 4) on dryer body 42. A second roller assembly 57 is connected to the inner frame 80 and is aligned with the first roller 56 assembly to facilitate the placement of totes within the inner frame. Rollers 56 and 57, in one actual embodiment, have a 2 ½ inch diameter and are made of stainless steel.

Inner frame 80 has three sides 92, 94 and 96 and a front opening 98 through which the totes 30 are inserted. It also has a bottom 97 which supports the totes. Bottom 97 is made of ½ inch plate steel, in one actual embodiment. While the totes, preferably, are first stacked and then inserted within inner frame 80, they can be inserted and stacked individually. A door 100 is rotatably attached to the inner frame by a hinge assembly 101. When the door is closed, it completes the enclosure of the stack of totes.

The inner door latching mechanism operates as follows. To open the door, a latch 104 is pivoted upwardly. This allows the operator to pivot lever 105 upwardly about pivot hinge 107. Vertical shaft 102 is held in place by three guide sleeves and is terminated at each end by hooks 108 which, when the door is closed, are engaged by securing eyes 113. When the operator rotates vertical shaft 102 about its axis this unhooks hooks 108 from securing eyes 113. In this position the door may be opened, pivoting about the hinge 101. The process is reversed to close and secure door 100.

The inner frame preferably is made of stainless steel. In one embodiment the frame is formed by 1 ¼ inch channels and the door is formed by ½ inch diameter tubing. The outer body 42 is made of stainless steel sheet metal.

Referring to FIG. 2B, it has been found that when drying whole head vegetables 110, there is a preferred way to place them in the totes 30. First and second rows 112 and 114 are formed with the cut or core ends 116 generally abutted or juxta positioned to each other with the leafy ends 119 facing outwardly, relative to the axis of rotation 120. Of course, the totes 30 are filled in layers of rows to fill them. It should also be understood that filling the totes in an actual production facility does not require a high degree of precision so there is no requirement that individual heads precisely abut each other.

Figure 7A:
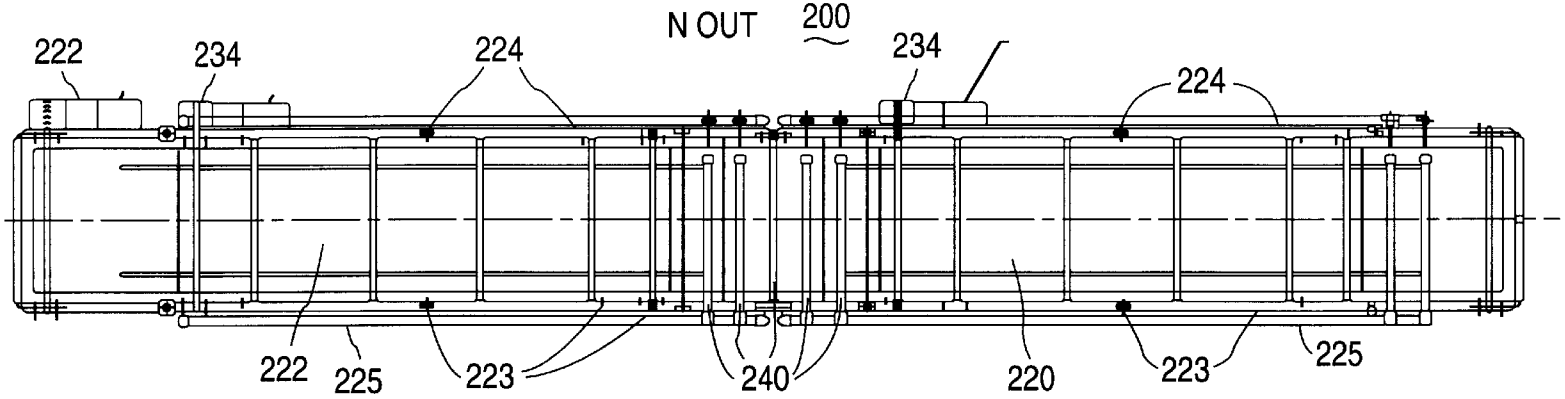
FIG. 7A is a top view.
Figure 7B:
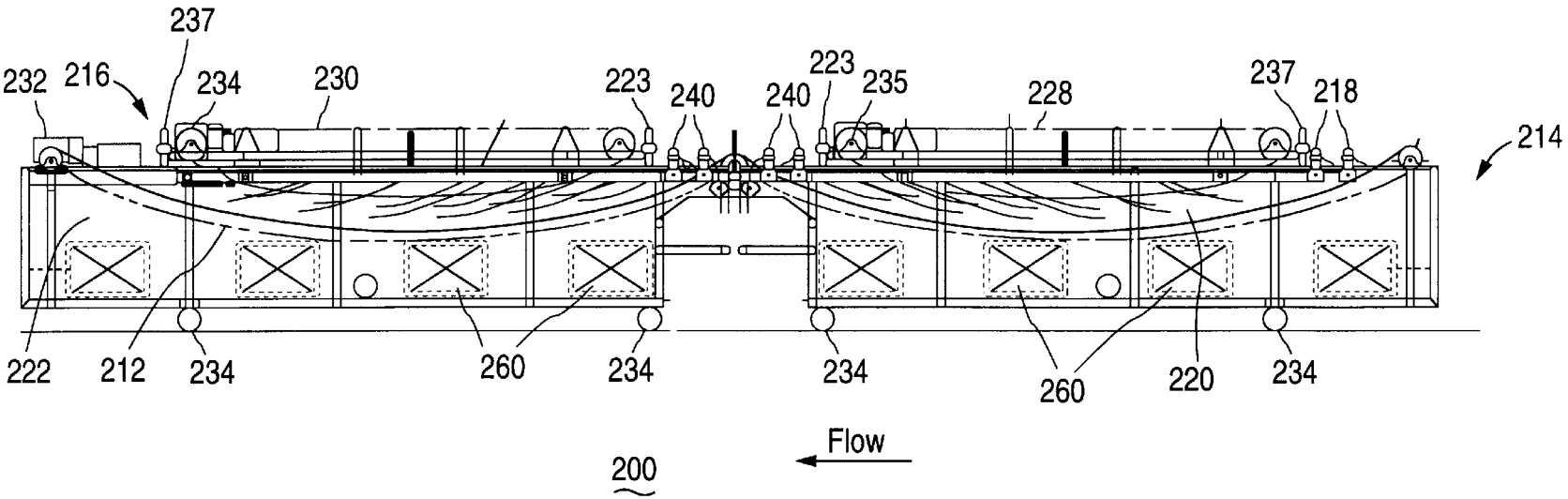
FIG. 7B is a side view of the improved produce washing machine of the present invention.
Figure 8:
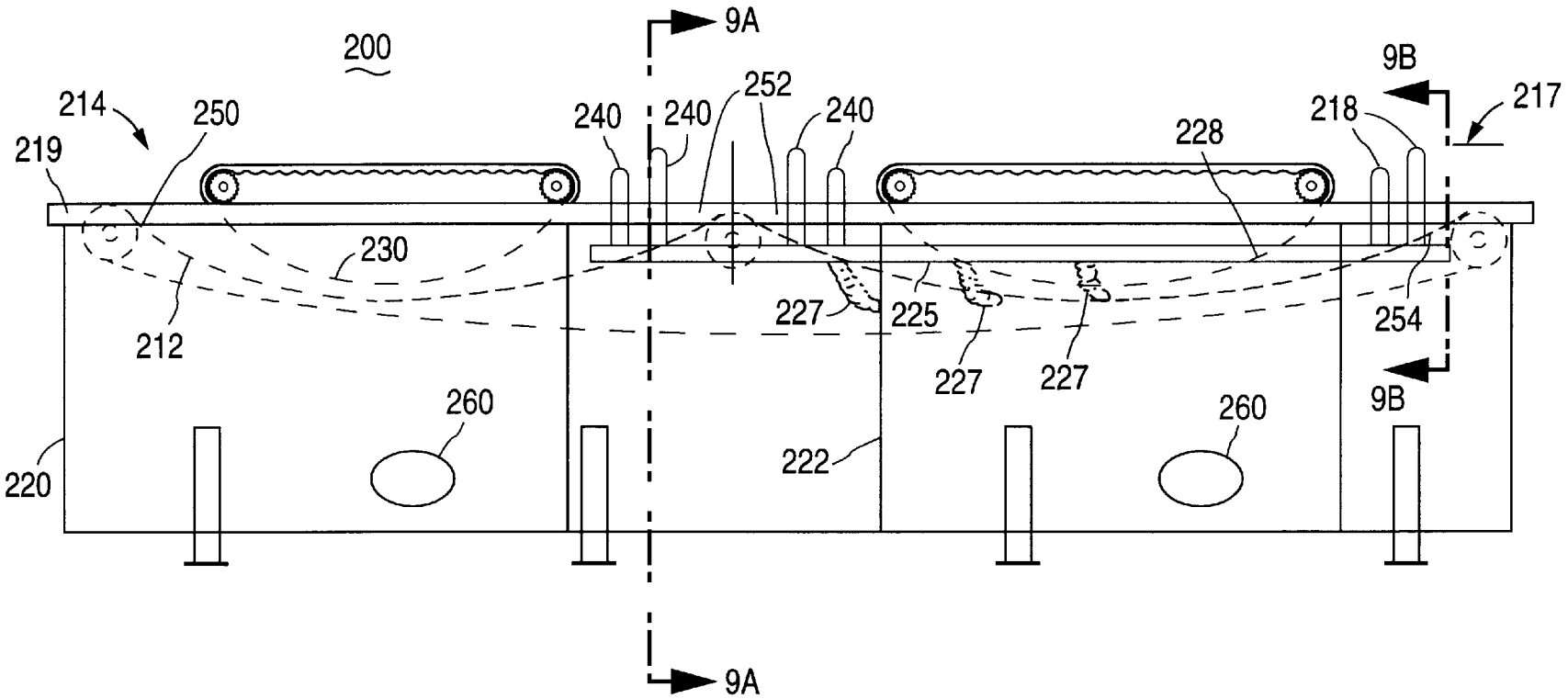
FIG. 8 is a simplified side view of the washer of FIG. 7C.

Referring to FIGS. 7A and 7B, FIG. 8 and FIG. 9, an improved washing machine 200 for washing produce, including whole head vegetables as shown. While any type of produce can be washed with the improved washer and method of the present invention, for purposes of this description, washing and drying of whole head vegetables will be described. As explained the whole head vegetables, after being harvested, are shipped to the plant first to be washed. The whole head vegetables are unpacked from the totes and loaded, in one to four rows, on an intralox type dewatering or lower belt 212 at the entry end 214 of the washing machine 200. Note the entry end of the washer 200 in FIGS. 7A and 7B is opposite to that in FIG. 8.

Figure 9A:
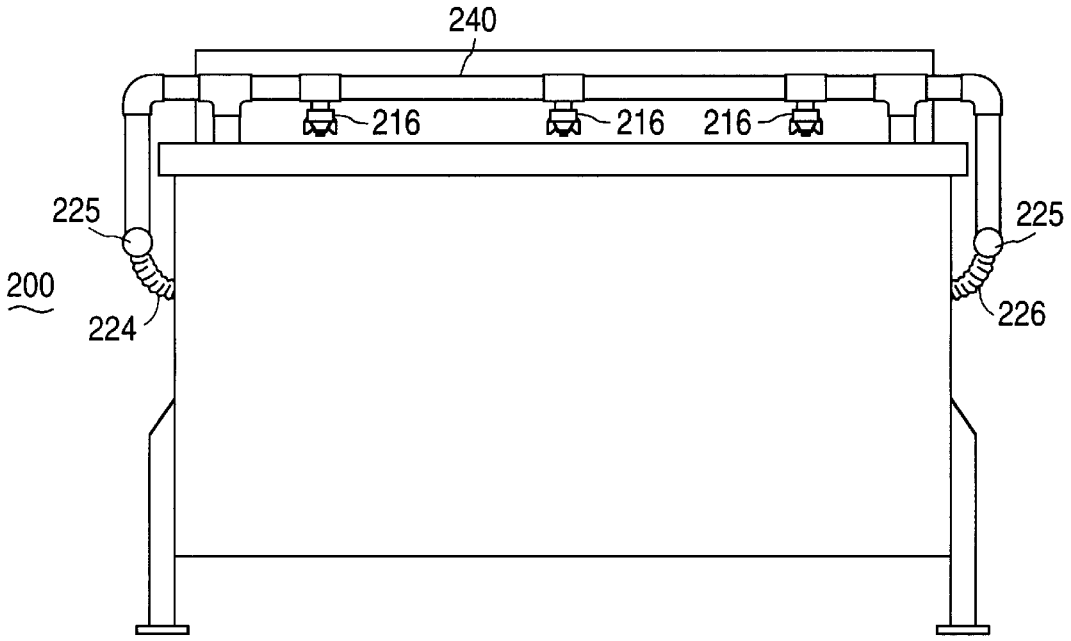
FIG. 9A and FIG. 9B are cross sectional views of the washer of FIG. 8.
Figure 9B:
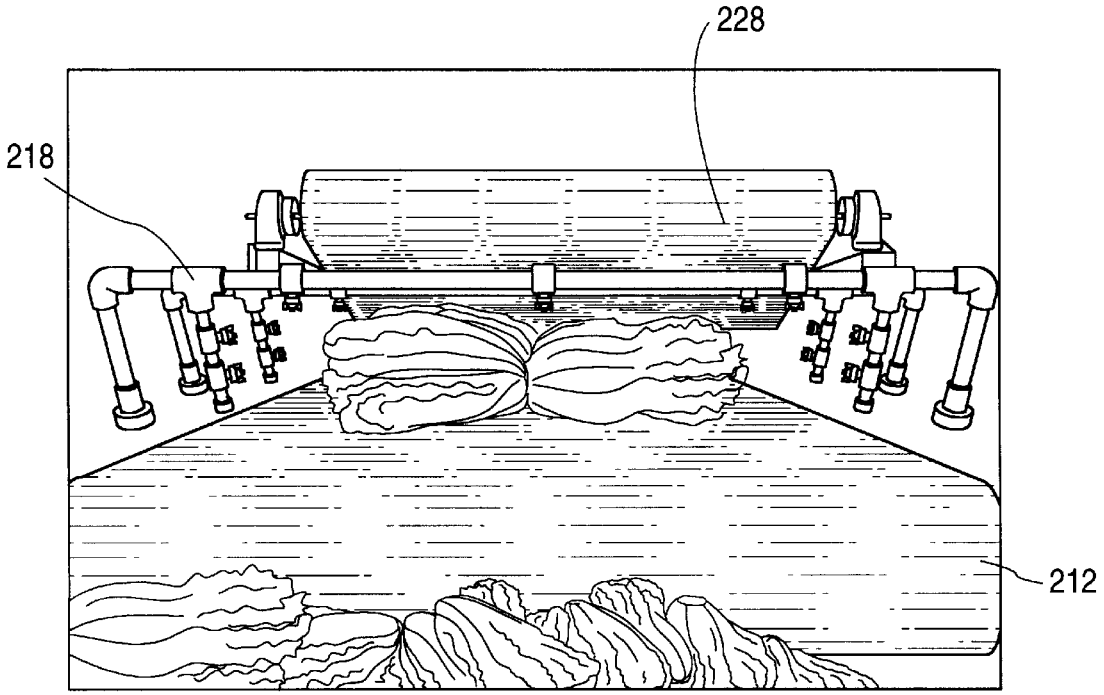

When placed on the dewatering belt, the produce, or product, is oriented with the core facing the centerline of the lower belt as shown in FIG. 9B. With this orientation the open ends of the whole head vegetables face cleaning jets 216 on a pair of entry spray bars 218. The dewatering belt 212 then runs down into and through the first of two water filled cleaning tanks 220 and 222 having a horizontal surface 219. The first tank 220 is cooled by the addition of chilled water to a temperature of 35–50 degrees F. The second tank 222 is cooled, by recirculating the water through a chiller (not shown), at a temperature of 33–40 degrees F. This differential avoids causing thermal shock in the product by cooling it gradually. Desirably, the cleaning tanks are made of stainless steel. For convenience the tanks may be mounted on casters 234. Access to the inside of the tanks 220 and 222 is through ports 260 as described later.

When the produce passes on lower belt 212 through the cleaning tanks 220 and 222, the produce is cleaned by turbulence caused by two rows of water jets 223 and 224 along each side of each tank which spray inwardly. One row is oriented slightly above the belt 212 and the other slightly below, while both are aimed at the center line of the product as it travels by. A pipe manifold 225 passes water via flexible tubing 227 to the water jets 223 and 224.

The produce is prevented from floating or "bobbing" in the water while submerged by means of a first dewatering top belt 228 and a second dewatering top belt 230. Each top belt 228 and 230 runs the length of one cleaning tanks 220 and 222, respectively, above or at the water level. The height of the belts is adjustable. Posts 237 are threaded, and by adjusting their position, adjusts the frame 1 to the belt. This is to accommodate different size products. The product then exits the first tank 220 at the end of its run as the bottom belt 212 travels up and over the lip of the first tank 220 and down into and through the second tank 222. It should be understood, however, that more than two cleaning tanks may be utilized as required.

The lower belt is driven by a ¾ horsepower motor 232 and each of the upper belts is driven by /2 horsepower motors 234. These motors are under the control of the speed control system of the present invention as explained in connection with FIG. 12.

Figure 10:
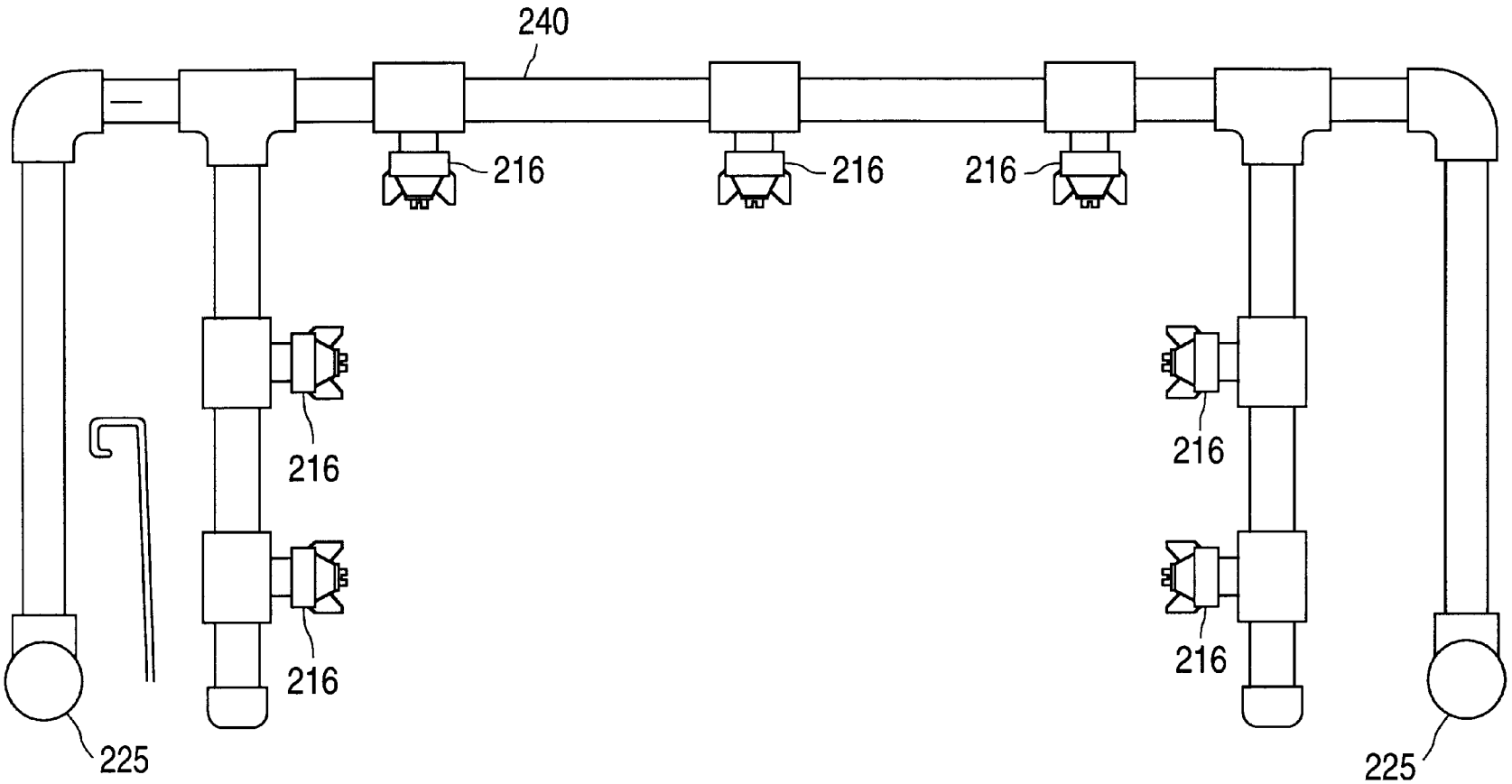
FIG. 10 is a detailed diagram of one of the plurality of spray bars.

In accordance with the present invention, between the two tanks 220 and 222 is a plurality of additional spray bars 240. Each spray bar 240 is provided with a plurality of quick tee jets 216. See, in particular FIGS. 9A, 9B and 10. The spray bars can be made from ¾ in. PVC. Cold water is provided via manifold 225 by a re-circulatory motor (not shown). With jets 226 positioned above and along side of the produce, there is sufficient coverage to rinse the produce from above, and from the side, and to penetrate the head of the vegetable. Afterwards, the product moves into the second tank 222. The second upper belt 230 keeps the product under the water, while it is cleaned by a duplicate jet system as in the first tank 220. The whole head product is then picked from the belt at its terminus 216 and loaded back into totes where it is delivered to dryer 40 described above.

Water is pumped into the cleaning tanks by pumps (not shown). It has been found that the use of a mesh screen at the inlet of the recirculating pump prevents stray leaves from being sucked in. The screen must be wide enough to span the width of the tank. It can be hinged to allow pivoting for cleaning.

Important to successful washing of the produce is to maintain the angle of the lower de-watering belt at optimum angles. If the angle is too shallow the product is not effectively washed. If the angles are too steep, the product will "skid" on the way into each cleaning tank and may not be able to "climb" back out. The angles also depend upon the product being washed. For example of a hearts line, a small line, the ideal entry angle (relative to horizonal surface 229 is −20 degrees at the start 250, −18 degrees at the middle 252, and −20 degrees at the finish 254. For a big line for larger products, the angles are −27 degrees at the start, −25 degrees in the middle, and −27 degrees at the finish.

Figure 11A:
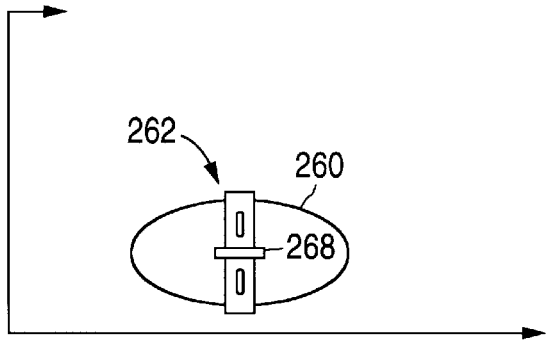
FIG. 11A is a front view and FIG. 11B is an end view of a cleaning tank showing cleaning ports.
Figure 11B:
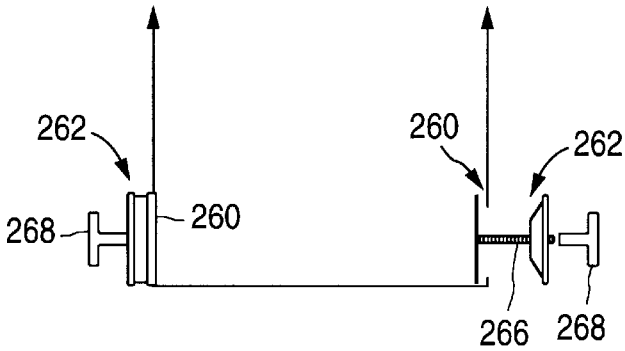
Figure 11C:
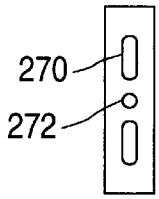
FIG. 11C, FIG. 11D and FIG. 11E are top, side and end views respectively, of the bracket of the door mechanism of the present invention.
Figure 11D:
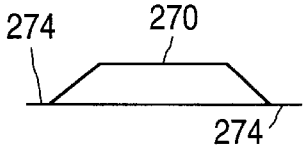

Referring to FIGS. 11A–11C, in accordance with another aspect of the invention, clean out ports 260 are provided for cleaning tanks 220 and 222, as shown in FIG. 8 and FIG. 11A–FIG. 11C. When the door assembly 262 is opened a hose can be inserted within the cleaning tanks and any debris can be removed. Normally, this is done on a daily basis.

Any number of clean out ports can be provided. In FIG. 11B two ports 260 are shown, with the door assembly on the left shown in the sealed or closed state. The door assembly 262 on the right is shown in an exploded view. FIGS. 11C–11H shows the door assembly in greater detail. Port 260 is sealed by an elliptically shaped sealing plate 264 which is larger than the port 260 and fits within the cleaning tank. Affixed perpendicularly to the sealing plate is a threaded rod 266, which in the preferred embodiment has a ⅝ in. thread. A T-shaped handle 268 is female threaded to engage the threaded rod 266.

Figure 11E:
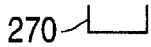
Figure 11F:
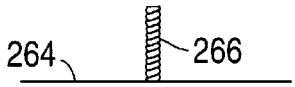
FIGS. 11F and 11G are side and top views, respectively, of the sealing plate of the door mechanism.
Figure 11G:
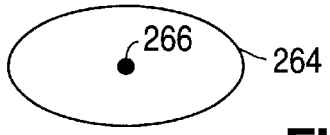
Figure 11H:
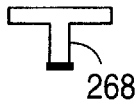
FIG. 11H is a plan view of the door mechanism handle.

A bracket 270 is provided with a hole 272 in its center through which passes the threaded rod 266. Bracket 270 is channel shaped as seen in FIG. 11E. It also is provided with lips 274 which engage the edge of port 260 when the handle is screwed down. Bracket 270 serves to provide tension when the handle is screwed down to seal the door. The water in the cleaning tanks must be removed before the doors 262 can be opened because water pressure on plate 264 seals the door tight.

Figure 12:
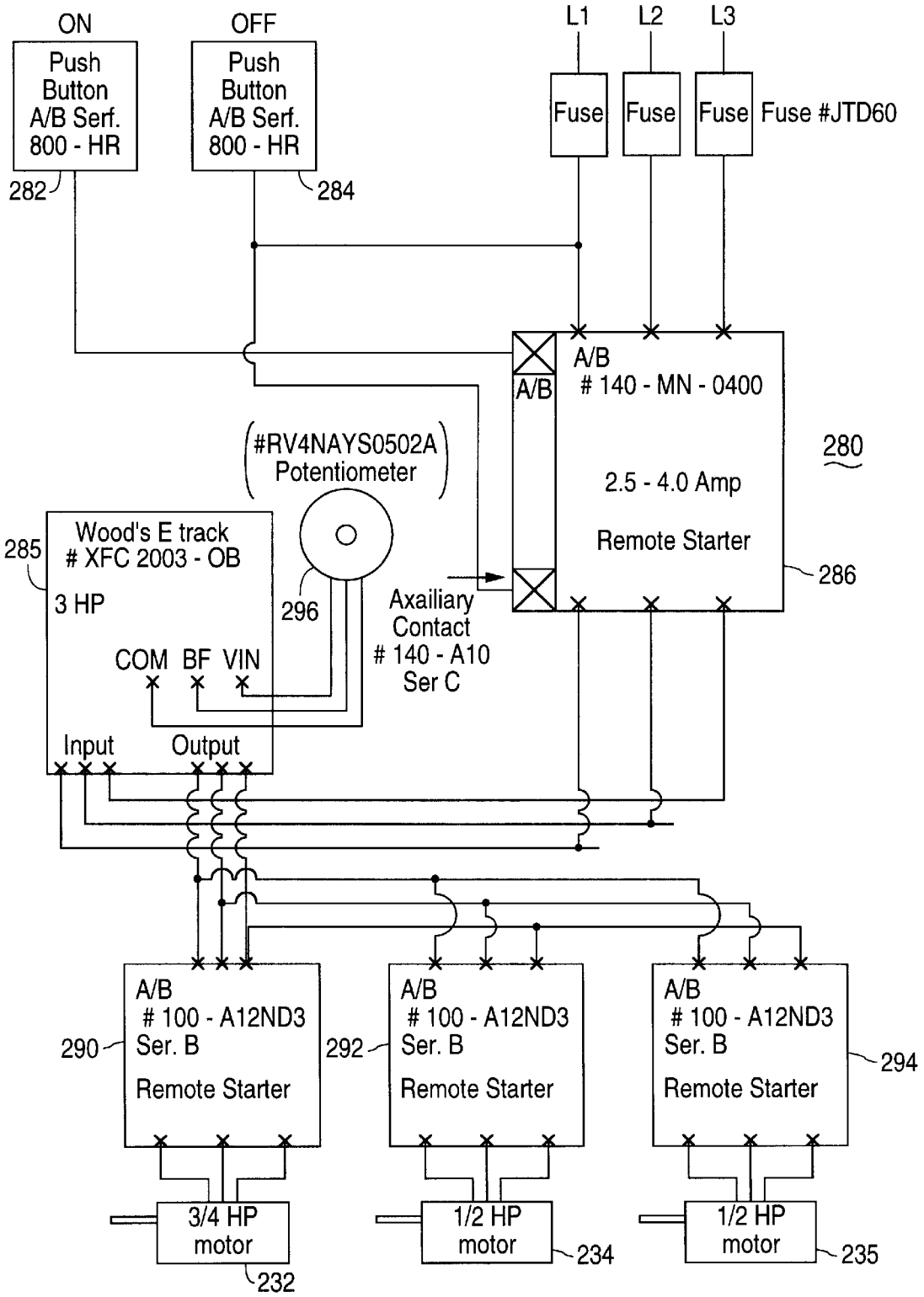
FIG. 12 is a block schematic diagram of the conveyer speed control system of the present invention.

FIG. 12 is a block schematic diagram 280 of the synchronized speed control for the motor 232 which drives the lower belt 212 and motors 234 and 235 which control upper belts 228 and 230. The operator controls an "ON" button 282 and an "OFF" button 284. Note that all of the components in FIG. 12 are commercially available and the part numbers are identified. "A/B" indicates an Allen-Bradley part. Three-phase power lines L1, L2, L3 bring power to a remote starter 286 which converts the 3-phase power to DC. An inverter changes the frequency of the power to the individual motors via individual remote starters 232, 234 and 236. The operator sets the speed of the motors/belts by adjusting potentiometer. With this system all of the belts travel at the same speed.

Although the present invention has been shown and described with respect to preferred embodiments, various changes and modifications are deemed to lie within the spirit and scope of the invention as claimed. The corresponding structures, materials, acts, and equivalents of all means or step plus function elements in the claims which follow are intended to include any structure, material, or acts for performing the functions in combination with other claimed elements as specifically claimed.

What is claimed is:

1. A method of processing whole head vegetables characterized by a core end, and an open leafy end, comprising the steps of:

washing the whole head vegetables;

loading the washed whole head vegetables into a plurality of individual totes;

stacking the plurality of individual totes loaded with the whole head vegetables within an enclosure; and rotating the enclosure about a rotational axis passing through the stacked totes so that moisture is centrifugally forced out of the whole head vegetables.

2. A method as in claim 1 including the step of arranging the whole head vegetables in two rows within each tote and generally abutting the core ends with the open ends oriented away from the axis of rotation.

3. An apparatus for processing harvested vegetables including whole head vegetables characterized by a core end, and an open leafy end, comprising the steps of:

a washer for washing the whole head vegetables;

a plurality of totes for transporting washed whole head vegetables;

a dryer having an enclosure for holding a stack totes filled with washed vegetables;

means for rotating the enclosure about a rotational axis passing through the stacked totes so that moisture is centrifugally forced out of the whole head vegetables, and wherein the whole head vegetables are arranged in two rows within each tote of the stacked totes, with the core end of each of the vegetables generally abutting and with the open ends oriented away from the axis of rotation.

4. A method for processing harvested produce characterized by a core end, and an open leafy end, comprising:

passing whole head vegetables through a washer which has a bottom belt which passes through a first and a second tanks of cleaning water;

further cleaning the whole head vegetables by spraying the vegetables with water from jets mounted on a plurality of spray bars when the produce is between the first and second cleaning tanks; and securing the produce as it passes through the first and second cleaning tanks between the top belts and bottom belt at each of the cleaning tanks.

5. The method of claim 4 including the step of controlling the speed of the lower belt, and the upper belts, by a single speed control system.

6. The method of claim 4 including the additional step of choosing the angle of the lower belt conveying the produce through the cleaning tanks for optimum performance.

7. An apparatus for processing harvested vegetables including whole head vegetables, characterized by a core end, and an open leafy end, comprising:

a lower belt for conveying harvested vegetables through at least first and a second tanks of cleaning water;

a plurality of spray bars to further clean the harvested vegetables by spraying the vegetables with water from jets mounted thereon, when the vegetables pass between the first and second cleaning tanks; and top belts at each of the cleaning tanks above the bottom belt to secure the vegetables on the lower conveyer belt as they pass through the first cleaning tank and through the second cleaning tank.

8. The apparatus of claim 7 including means for controlling the speed of the lower belt, and the top belts, by a single speed control system.

9. The apparatus of claim 7 wherein the lower belt enters the first cleaning tank at an angle of between about −20 degrees to about −27 degrees relative to horizontal.

10. The apparatus of claim 7 wherein the lower belt exits the first cleaning tank and enters the second cleaning tank at an angle of about −20 degrees to about −25 degrees relative to horizontal.

11. The apparatus of claim 7 wherein the lower belt exits the second tank at an angle of about −20 degrees to about −27 degrees relative to horizontal.

12. The apparatus of claim 7 wherein each of the cleaning tanks is provided with at least one clean out port.

13. The apparatus of claim 12 wherein the at least one cleanout port is provided with a door latch mechanism.

14. The apparatus of claim 7 including a centrifugal dryer for drying the washed vegetables.

15. The apparatus of claim 7 wherein the centrifugal dryer dries vegetables which are stored in totes comprising:

an outer dryer body having a top and bottom, an outer body opening, a door for enclosing the outer body opening during the operation of the dryer, and top and bottom spindle supports located in the top and bottom of the dryer body;

an inner frame having an opening which can be aligned with the outer body opening so that a plurality of totes can be placed and stacked within the inner frame;

spindle shafts attached at the top and bottom of the inner frame which define an axis of rotation and which are rotatably supported by the top and bottom spindle supports, respectively;

a motor for rotating the inner frame about the rotational axis during operation of the dryer; and a door for closing the opening in the inner frame after the totes have been stacked within the frame.

16. A centrifugal dryer as in claim 15 wherein the totes are rectangular in shape and the inner frame is also rectangular and and a stack of totes which conforms to the shape of the inner frame.

17. A centrifugal dryer as in claim 15 wherein the vegetables are whole head vegetables having cut ends and leafy ends which are placed within the totes in rows wherein the cut ends are generally adjacent to each other and the leafy ends extend outwardly in a direction generally away from the axis of rotation.

* * * * *